United States Patent [19]

Carlin

[11] 4,250,013

[45] Feb. 10, 1981

[54] METHOD OF DEPOSITING A CATALYST TO FORM A SOLID POLYMER ELECTROLYTE MEMBRANE

[75] Inventor: William W. Carlin, Portland, Tex.

[73] Assignee: PPG Industries, Inc., Pittsburgh, Pa.

[21] Appl. No.: 15,529

[22] Filed: Feb. 23, 1979

[51] Int. Cl.[3] ..... C25B 11/06; C25B 11/08; C25B 13/08; C25B 11/03

[52] U.S. Cl. ..... 204/282; 204/283

[58] Field of Search ..... 204/282, 283

[56] References Cited

U.S. PATENT DOCUMENTS

| | | | |
|---|---|---|---|
| 2,913,511 | 11/1959 | Grubb, Jr. | 136/86 |
| 3,423,228 | 1/1969 | Oster et al. | 117/47 |
| 3,489,670 | 1/1970 | Maget | 204/129 |
| 3,767,542 | 10/1973 | Carlson | 204/98 |
| 4,057,479 | 11/1977 | Campbell | 204/266 |

FOREIGN PATENT DOCUMENTS

| | | | |
|---|---|---|---|
| 2741956 | 9/1976 | Fed. Rep. of Germany | 204/98 |

*Primary Examiner*—R. L. Andrews

*Attorney, Agent, or Firm*—Richard M. Goldman

[57] ABSTRACT

Disclosed is a method of operating a solid polymer electrolyte chlor-alkali cell by imposing a pulsative current, e.g., pulsed direct current, half wave alternating current, or rectified alternating current, across the cell.

Also disclosed is the chemical deposition of porous catalysts on a permionic membrane whereby to obtain a solid polymer electrolyte.

4 Claims, 14 Drawing Figures

Fig.11
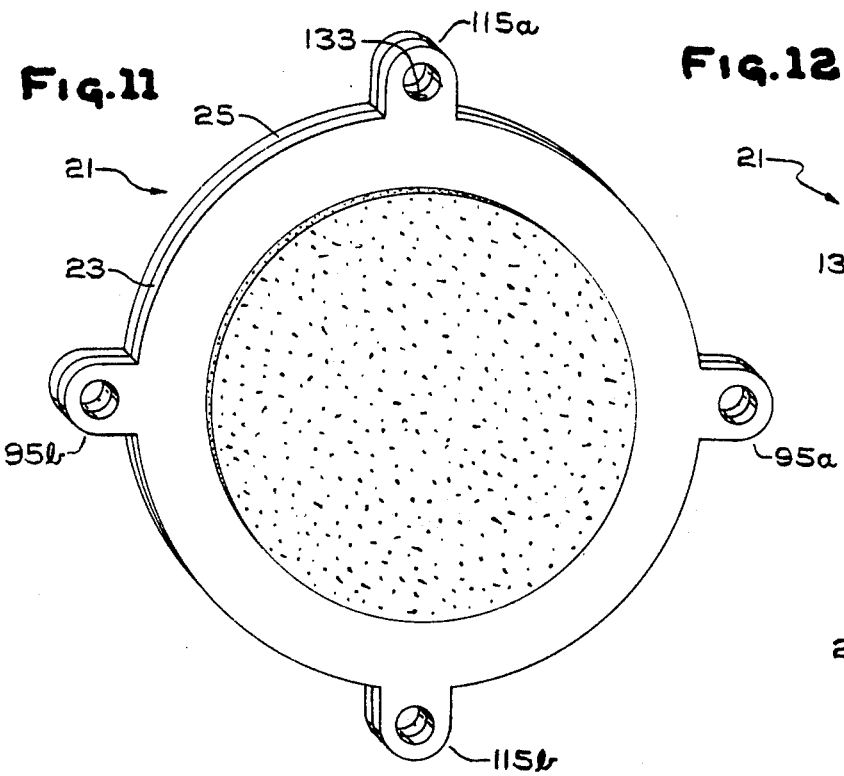
Fig.12
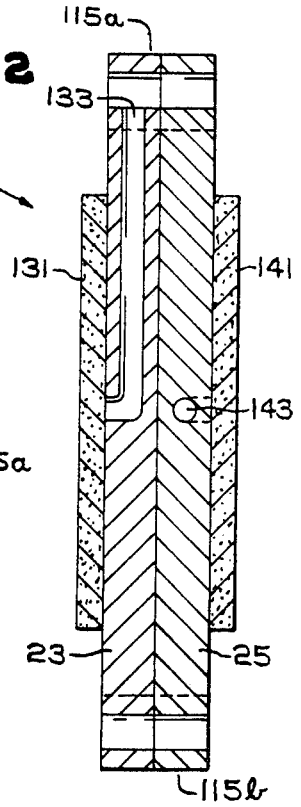
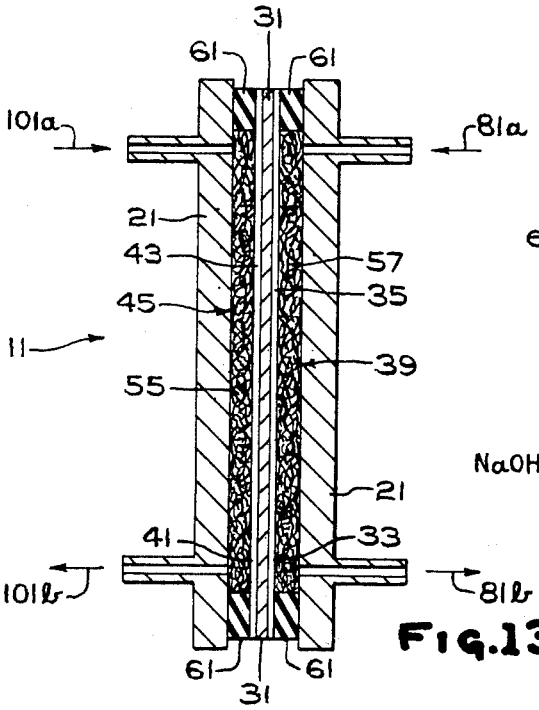
Fig.13
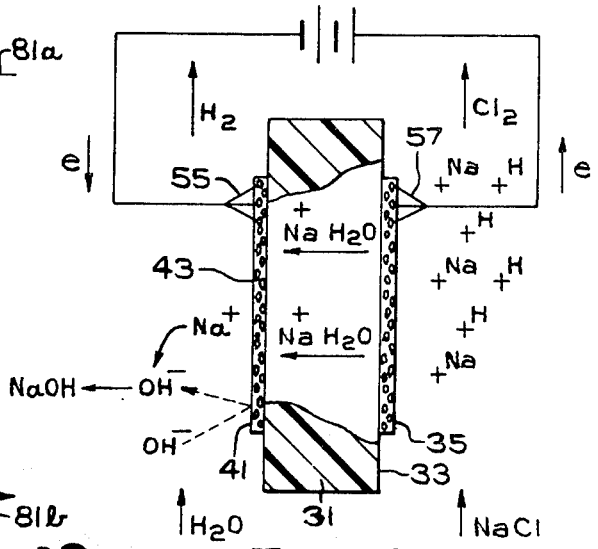
Fig.14

METHOD OF DEPOSITING A CATALYST TO FORM A SOLID POLYMER ELECTROLYTE MEMBRANE

DESCRIPTION OF THE INVENTION

Solid polymer electrolyte chlor alkali cells have a cation selective permionic membrane with an anodic electrocatalyst embedded in and on the anodic surface of the membrane, that is in and on the anolyte facing surface of the permionic membrane, and a cathodic hydroxyl evolution catalyst, i.e., a cathodic electrocatalyst, embedded in and on the cathodic surface of the membrane, that is the catholyte facing surface of the permionic membrane. In an alternative exemplification, a cathode depolarizer, also known equivalently as an $HO_2^-$ disproportionation catalyst, is present on the cathodic surface, that is the catholyte facing surface of the permionic membrane. This $HO_2^-$ disproportionation catalyst serves to depolarize the cathode and avoid the formation of gaseous hydrogen.

Solid polymer electrolyte chlor alkali bipolar electrolyzers herein contemplated offer the advantages of high production per unit volume of electrolyzer, high current efficiency, high current density, and in an alternative exemplification, the avoidance of gaseous products and the concomittant auxiliaries necessitated by gaseous products.

In the solid polymer electrolyte chlor alkali process aqueous alkali metal chloride, such as sodium chloride or potassium chloride, contacts the anodic surface of the solid polymer electrolyte. An electrical potential is imposed across the cell with chlorine being evolved at the anodic surface of the solid polymer electrolyte.

Alkali metal ion, that is sodium ion or potassium ion, is transported across the solid polymer electrolyte permionic membrane to the cathodic hydroxyl evolution catalyst on the opposite surface of the permionic membrane. The alkali metal ion, that is the sodium ion or potassium ion is transported with its water of hydration, but with substantially no transport of bulk electrolyte.

Hydroxyl ion is evolved at the cathodic hydroxyl ion evolution catalyst as is hydrogen. However, in an alternative exemplification, a cathodic depolarization catalyst, i.e., an $HO_2^-$ disproportionation catalyst, is present in the vicinity of the cathodic surface of the permionic membrane and an oxidant is fed to the catholyte compartment to avoid the generation of gaseous cathodic products.

THE FIGURES

FIG. 11 is a perspective view of an alternative exemplification of a bipolar element having distributor means combined with the bipolar element.

FIG. 12 is a cutaway side elevation of the bipolar element shown in FIG. 11.

FIG. 13 is a schematic cutaway side elevation of the solid polymer electrolyte electrolytic cell.

FIG. 14 is a schematic of the solid polymer electrolyte chloralkali process.

DETAILED DESCRIPTION OF THE INVENTION

Figure 1:
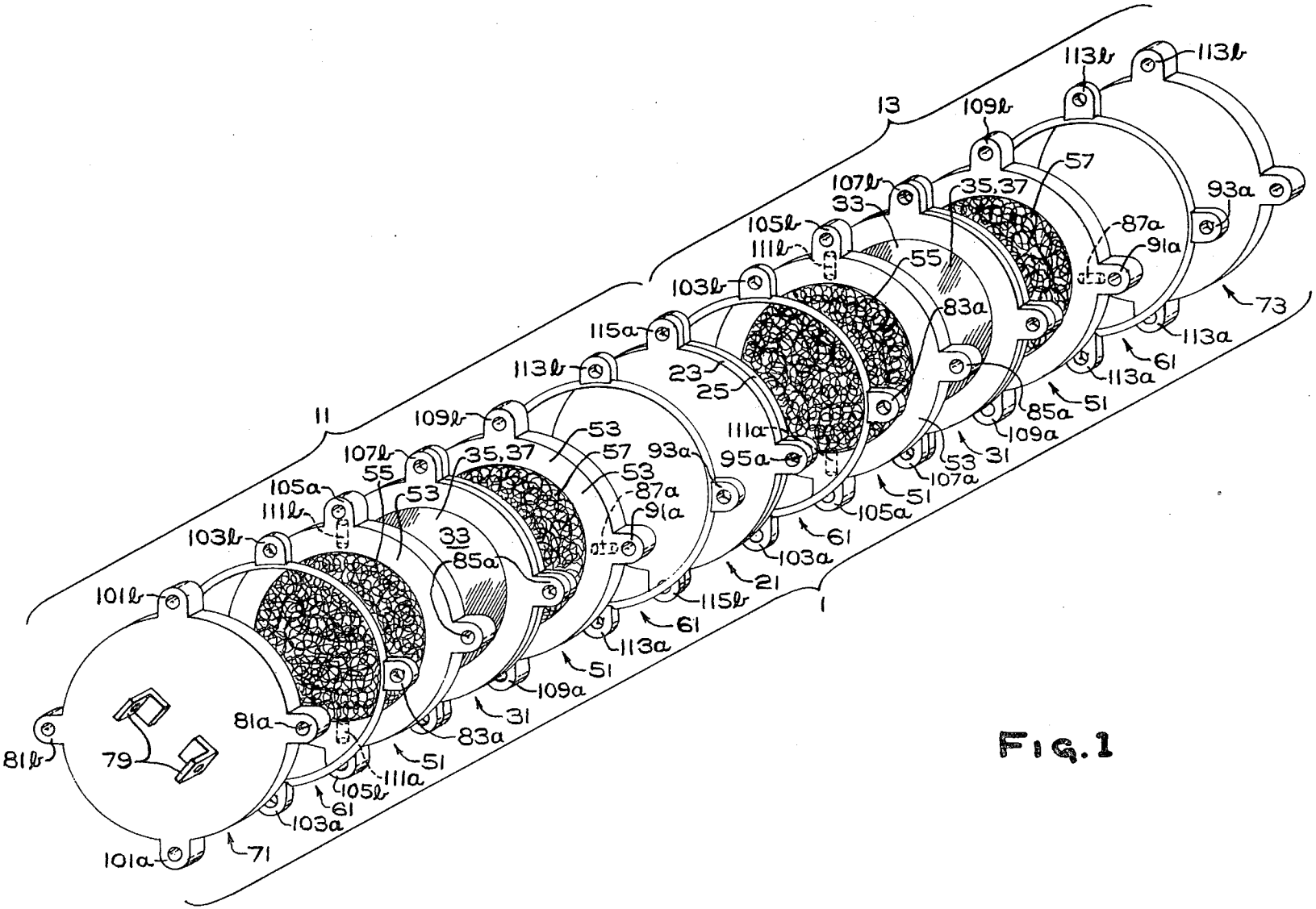
FIG. 1 is an exploded view of a bipolar, solid polymer electrolyte electrolyzer.

The chlor alkali cell shown schematically in FIG. 14 has a solid polymer electrolyte 31 with a permionic membrane 33 therein. The permionic membrane 33 has an anodic surface 35 with chlorine catalyst 37 thereon and a cathodic surface 41 with cathodic hydroxyl evolution catalyst 43 thereon. Also shown is an external power supply connected to the anodic catalyst 37 by distributor 57 and connected to the cathodic catalyst 43 by distributor 55.

Brine is fed to the anodic side of the solid polymer electrolyte 31 where it contacts the anodic chlorine evolution catalyst 37 on the anodic surface 35 of the permionic membrane 31. The chlorine, present as chloride ion in the solution, forms chlorine according to the reaction:

$$2Cl^- \rightarrow Cl_2 + 2e^-$$

The alkali metal ion, that is sodium ion or potassium ion, shown in FIG. 14 as sodium ion, and its water of hydration, passes through the permionic membrane 33 to the cathodic side 41 of the permionic membrane 33. Water is fed to the catholyte compartment both externally, and as water of hydration passing through the permionic membrane 31. The stoichiometric reaction at the cathodic hydroxyl evolution catalyst is:

$$H_2O + e^- \rightarrow OH^- + H$$

In an alternative exemplification, a cathode depolarizing catalyst and an oxidant are present whereby to avoid the generation of gaseous hydrogen.

The structure for accomplishing this reaction is shown generally in FIG. 13 where electrolytic cell 11 is shown with walls 21 and a permionic membrane 33 therebetween. The permionic membrane 33 has an anodic surface 35 and an anodic electrocatalyst 37 on the anodic surface 35, and a cathodic surface 41 with cathodic electrocatalyst 43 thereon. In an alternative exemplification, a cathode depolarization catalyst, that is an $HO_2-$ disproportionation catalyst (not shown) is in the vicinity of the cathodic surface 41 of the membrane 33 whereby to avoid the evolution of hydrogen gas.

Means for conducting electrical current from the walls 21 to the solid polymer electrolyte 31 are as shown as distributor 57 in the anolyte compartment 39 which conducts current from the wall 21 to the anodic chlorine evolution catalyst 37, and distributor 55 in the catholyte compartment 45 which conducts current from the wall 21 to the cathodic hydroxyl evolution catalyst 43.

In a preferred exemplification, the distributors, 55 and 57 also provide turbulence and mixing of the respective electrolytes. This avoids concentration polarization, gas bubble effects, stognation, and dead space.

In cell operation, brine is fed to the anolyte compartment 39 through brine inlet 81*a* and depleted brine is withdrawn from the anolyte compartment 39 through brine outlet 81*b*. The anolyte liquor may be removed as a chlorine gas containing froth, or liquid chlorine and liquid brine may be removed together.

Water is fed to the catholyte compartment 45 through water feed means 101*a* to maintain the alkali metal hydroxide liquid thereby avoiding deposition of solid alkali metal hydroxide on the membrane 33. Additionally, oxidant may be fed to the catholyte compartment 45, for example when an $HO_2^-$ disproportionation catalyst is present, whereby to avoid formation of hydrogen gas and to be able to withdraw a totally liquid cathode product.

One particularly desirable cell structure is a bipolar electrolyzer utilizing a solid polymer electrolyte. FIG. 1 is an exploded view of a bipolar solid polymer electrolyte electrolyzer. The electrolyzer is shown with two solid polymer electrolytic cells 11 and 13. There could however be many more such cells in the electrolyzer 1. The limitation on the number of cells, 11 and 13, in the electrolyzer 1 is imposed by rectifier and transformer capabilities as well as the possibilities of current leakage. However, electrolyzers containing upwards from 150 or even 200 or more cells are within the contemplation of the art utilizing presently available rectifier and transformer technologies.

Figure 2:
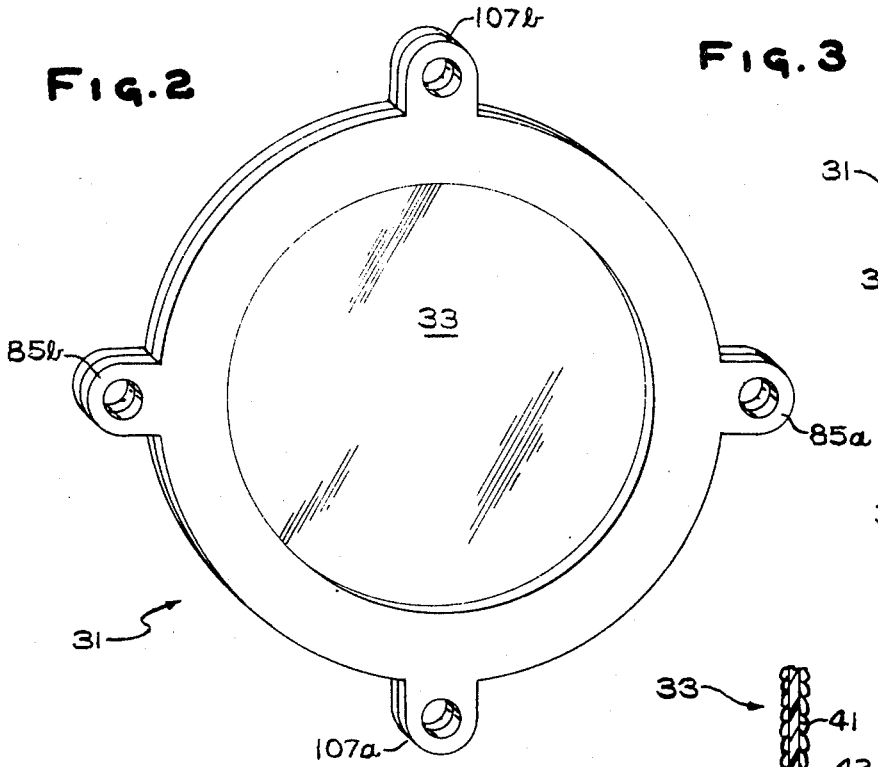
FIG. 2 is a perspective view of a solid polymer electrolyte unit of the bipolar electrolyzer shown in FIG. 1.
Figure 3:
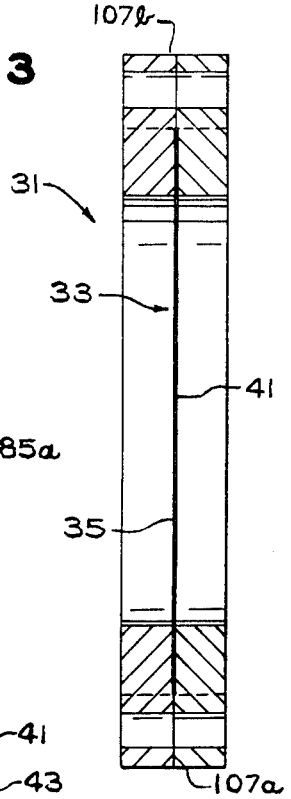
FIG. 3 is a cutaway elevation of the solid polymer electrolyte unit shown in FIG. 2.
Figure 4:
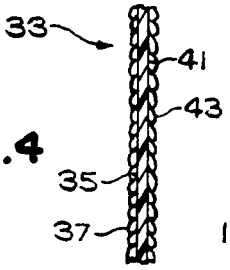
FIG. 4 is a cutaway elevation, in greater magnification of the solid polymer electrolyte sheet shown in the unit of FIGS. 2 and 3.

Individual electrolytic cell 11 contains a solid polymer electrolyte unit 31 shown as a part of the electrolyzer in FIG. 1, individually in FIG. 2, in partial cutaway in FIG. 3, and in higher magnification in FIG. 4 with the catalyst particles 37 and 43 exaggerated. Solid polymer elctrolyte unit 31 is also shown schematically in FIGS. 13 and 14.

The solid polymer electrolyte unit 31 includes a permionic membrane 33 with anodic chlorine evolution catalyst 37 on the anodic surface 35 of the permionic membrane 33 and cathodic hydroxyl evolution catalyst 43 on the cathodic surface 41 of the permionic membrane 33.

The cell boundaries, may be, in the case of an intermediate cell of the electrolyzer 1, a pair of bipolar units 21 also called bipolar backplates. In the case of the first and last cells of the electrolyzer, such as cells 11 and 13 shown in FIG. 1, a bipolar unit 21 is one boundary of the individual electrolytic cell, and end plate 71 is the opposite boundary of the electrolytic cell. The end plate 71 has inlet means for brine feed 81*a*, outlet means for brine removal 81*b*, inlet means water feed 101*a*, and hydroxyl solution removal 101*b*. Additionally, when the cathode is depolarized, oxidant feed, not shown would also be utilized. The end plate 71 also includes current connectors 79.

In the case of an monopolar cell, the end units would be a pair of end plates 71 as described above.

The end plate 71 and the bipolar units 21 provide gas tight and electrolyte tight integrity for the individual cells. Additionally, the end plate 71 and the bipolar units 21 provide electical conductivity, as well as in various embodiments, electrolyte feed and gas recovery.

Figure 7:
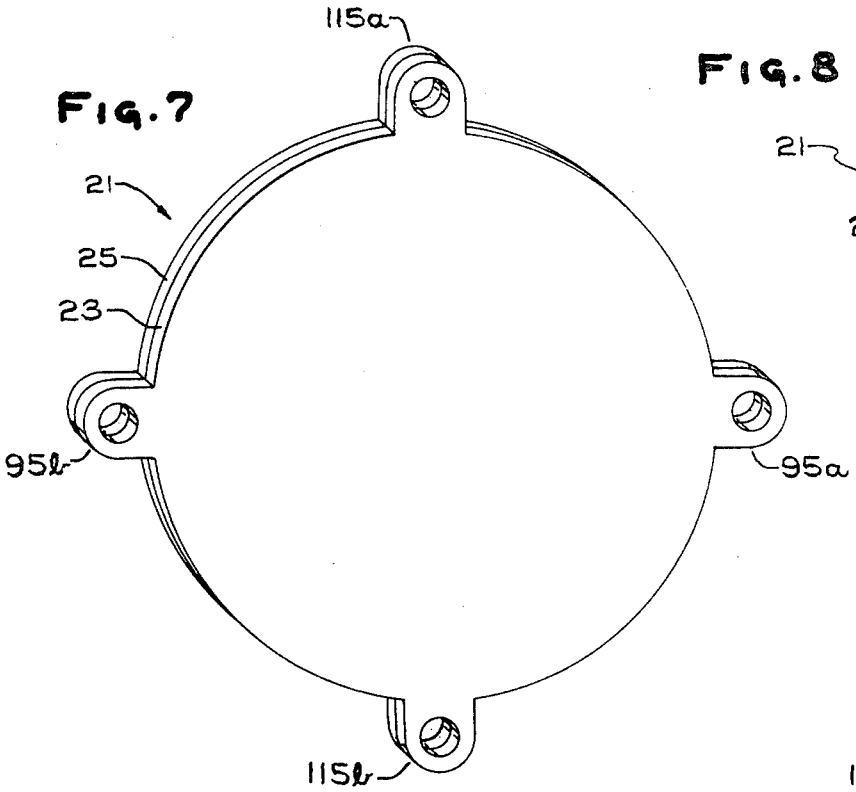
FIG. 7 is a perspective view of one exemplification of the bipolar element shown in FIG. 1.
Figure 8:
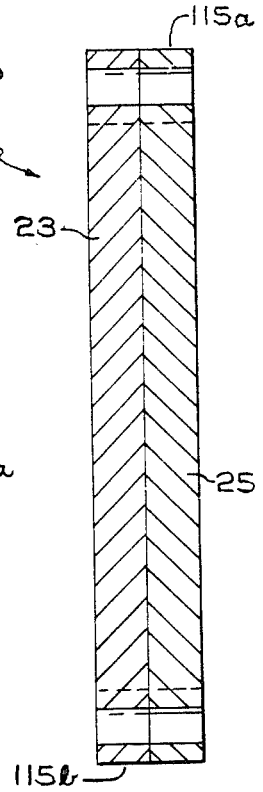
FIG. 8 is a cutaway side elevation of the bipolar element shown in FIG. 7.

The bipolar unit 21, shown in FIGS. 7 and 8 has anolyte resistant surface 23 facing the anodic surface 35 and anodic catalyst 37 of one cell 11. The anolyte resistant surface 35 contacts the anolyte liquor and forms the boundary of the anolyte compartment 39 of the cell. The bipolar unit 21 also has a catholyte resistant surface 25 facing the cathodic surface 41 and cathode catalyst 43 of the solid polymer electrolyte 31 of the next adjacent cell 13 of electrolyzer 1.

The anolyte resistant surface 23 can be fabricated of a valve metal, that is a metal which forms an acid resistant oxide film upon exposure to aqueous acidic solutions. The valve metals include titanium, tantalum, tungsten, columbium, hafnium, and zirconium, as well as alloys of titanium, such as titanium with yttrium, titanium with palladium, titanium with molybdenum, and titanium with nickel. Alternatively, the anolyte resistant surface may be fabricated of silicon or a silicide.

The catholyte resistance surface 25 may be fabricated of any material resistant to concentrated caustic solutions containing either oxygen or hydrogen or both. Such materials include iron, steel, stainless steel and the like.

The two members 23 and 25 of the bipolar unit 21 may be sheets of titanium and iron, sheets of the other materials specified above, and there may additionally be a hydrogen barrier interposed between the anodic surface 23 and cathodic surface 25, whereby to avoid the transport of hydrogen through the cathodic surface 25 of a bipolar unit to the anodic surface 23 of the bipolar unit.

Figure 9:
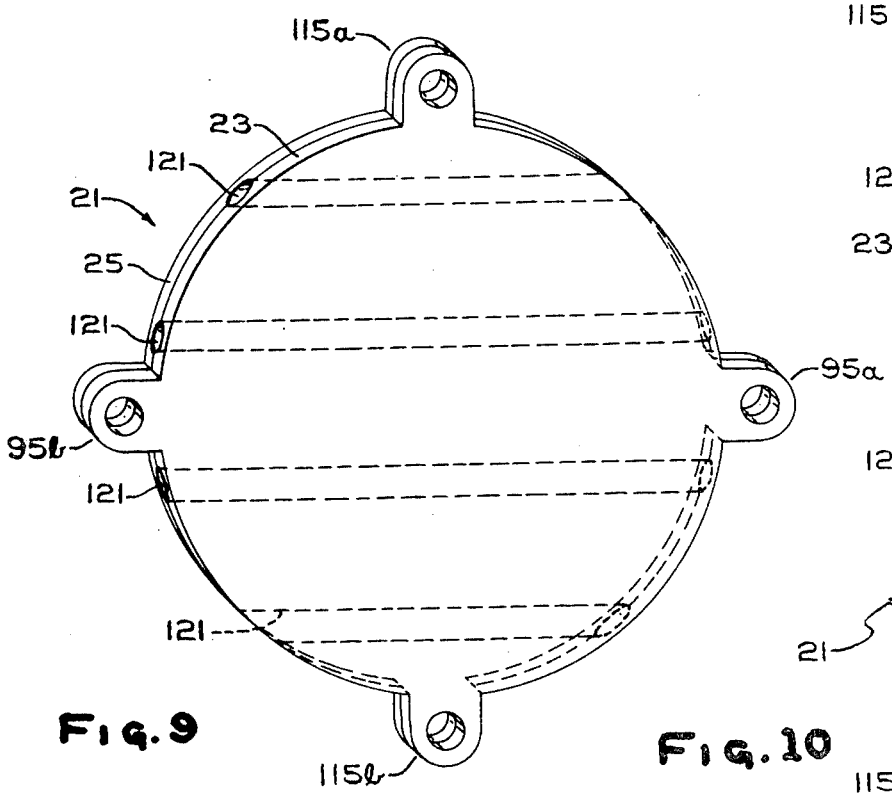
FIG. 9 is a perspective view of an alternative exemplification of a bipolar element having heat exchange means passing therethrough.
Figure 10:
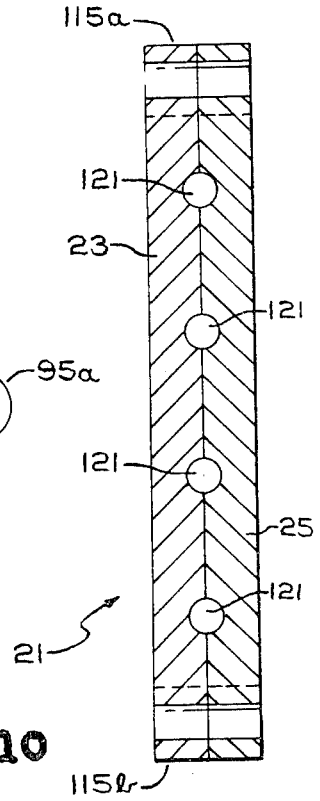
FIG. 10 is a cutaway side elevation of the bipolar element shown in FIG. 9.

In an alternative exemplification shown in FIGS. 9 and 10, heat exchanger conduits 121 pass through the bipolar unit 21. These heat exchanger conduits 121 carry cool liquid or cool gas to extract heat from the electrolyzer, for example $I^2R$ generated heat as well as the heat of reaction. This enables a lower pressure to be used when the electrolyzer is pressurized, as when a liquid chlorine is the desired product or when oxygen is fed under pressure or both.

In a still further exemplification of the bipolar solid polymer electrolyte electrolyzer, shown in FIGS. 11 and 12 the electrolyte feed and distribution function is performed by the bipolar unit 21. Thus, in addition to or in lieu of distributor 51, line 133 extends from conduit 115*a* to the interior of the bipolar unit 21 then to a porous or open element 131 which distributes the electrolyte. Analogously for the opposite electrolyte, feed is through pipe 143 to a porous or open surface 141 on the opposite surface of the bipolar unit.

Figure 5:
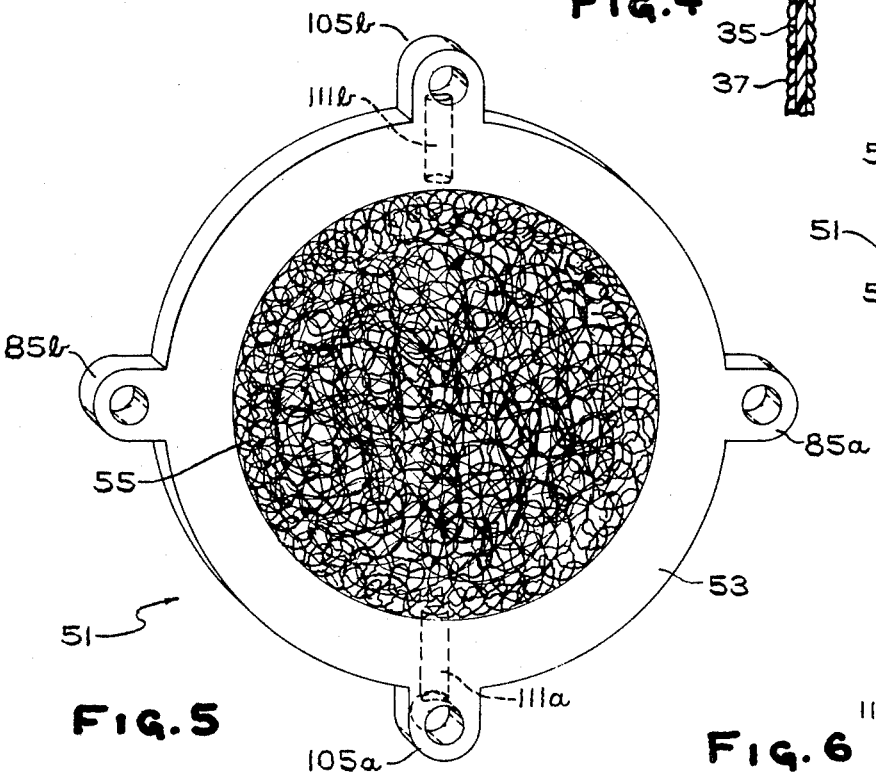
FIG. 5 is a perspective view of the distributor showing one form of electrolyte feed and recovery.
Figure 6:
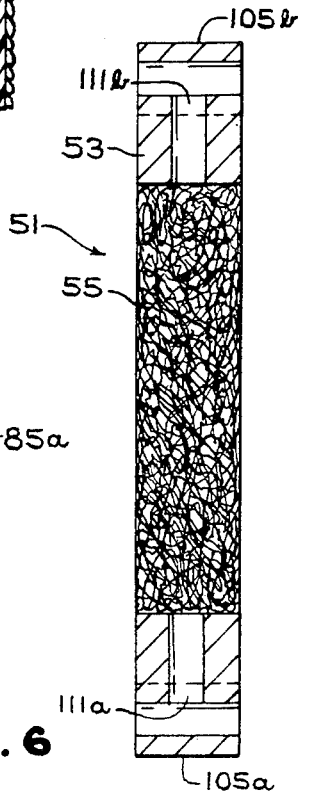
FIG. 6 is a cutaway side elevation of the distributor shown in FIG. 5

The individual electrolytic cells 11 and 13 of bipolar electrolyzer 1 also include distributor means 51 which may be imposed between the ends of the cell, that is between the bipolar unit 21 or end wall 71 and the solid polymer electrolyte 31. This distributor means is shown in FIG. 1 and individually in FIGS. 5 and 6 with the catholyte liquor conduits 105*a* and 105*b* and the catholyte feed 111*a* and catholyte recovery 111*b*.

The peripheral wall 53 of the distributor 51 is shown as a circular ring. It provides electrolyte tight and gas tight integrity to the electrolyzer 1 as well as to the cells 11 and 13.

The packing, which may be caustic resistant as packing 55, or acidified chlorinated brine and chlorine resistant, as packing 57, is preferably resilient, conductive, and substantially noncatalytic. That is, packing 55 of the catholyte unit, in the catholyte compartment 45 has a higher hydrogen evolution or hyroxyl ion evolution over voltage then cathodic catalyst 43 whereby to avoid the electrolytic evolution of cathodic product thereon. Similarly, the packing 57 in the anolyte compartment 39 has a higher chlorine evolution over voltage and higher oxygen evolution over voltage than the anodic catalyst 37 whereby to avoid the evolution of chlorine or oxygen thereon.

The packing 55, and 57 serves to conduct current from the boundary of the cell such as bipolar unit 21 or end plate 71, to the solid polymer electrolyte 31. This necessitates a high electrical conductivity. The conduction is carried out while avoiding product evolution thereon, as described above. Similarly, the material must have a minimum of contact resistance at the solid polymer electrolyte 31 and at the boundaries of the individual cell 11, e.g., end wall 71 or bipolar unit 21.

Furthermore, the distributor packing 55, 57 distributes and diffuses the electrolyte in the anolyte compartment 39 or catholyte compartment 45 whereby to avoid concentration polarization, the build up of stagnant gas and liquid pockets, and the build up of solid deposits such as potassium hydroxide or sodium hyroxide deposits.

The packing 55,57 may be carbon, for example in the form of graphite, carbon felt, carbon fibers, porous graphite, activated carbon or the like. Alternatively, the packing may be a metal felt, a metal fiber, a metal sponge, metal screen, graphite screen, metal mesh, graphite mesh, or clips or springs or the like, such clips or springs bearing on the solid polymer electrolyte and on the bipolar unit 21 of the end plate 71. Alternatively, the packing 51,57 may be packing as rings, spheres, cylinders or the like, packed tightly to obtain high conductivity and low electrical contact resistance.

In one exemplification the brine feed 87*a* and brine withdrawal 87*b*, as well as the water and oxidant feed 111*a*, and catholyte liquor recovery 111*b*, may be combined with distributors 51,51. In such an exemplification the feed 87*a* and 111*a* extend into the packing 55 and 57 and the withdrawal 87*b* and 111*b* extends from the packing 55 and 57.

In an alternative exemplification the reagent feed and product recovery may be to a microporous distributor, for example microporous hydrophilic or microporous hydrophobic films bearing upon the solid polymer electrolyte 31 and under compression by the distributor means 55 and 57. In an exemplification where the feed is to microporous films upon the solid polymer electrolyte 31, the catalyst particles 37 and 43 may be in the microporous film as well as on the surface of the solid polymer electrolyte 35 and 41.

As described above, individual solid polymer electrolyte electrolytic cell 11 and 13 includes a solid polymer electrolyte 31 with a permionic membrane 33 having anodic catalyst 37 on the anodic surface 35 thereof, and cathodic catalyst 43 on the cathodic surface 41 thereof. The boundaries of the cell may be a bipolar unit 21 or an end plate 71, with electrical conduction between the boundaries and the solid polymer electrolyte 31 being by distributor means 51. Reagent feed 87*a* and 111*a* and product recovery 87*b* and 111*b* are also provided. Additionally, there must be provided means for maintaining and providing an electrolyte tight, gas tight seal as gasket 61. While gasket 61 is only shown between walls 71 and bipolar units 21, and the distributors 51, it is to be understood that additionally or alternatively, gasket 61 may be interposed between the distributors 51, and the solid polymer electrolyte 31.

Gaskets in contact with the anolyte compartment 39 should be made of any material that is resistant to acidified, chlorinated brine as well as to chlorine. Such materials include unfilled silicon rubber as well as various resilient fluorocarbon materials.

The gaskets 61 in contact with the catholyte compartment 45 may be fabricated of any material which is resistent to concentrated caustic soda.

One particularly satisfactory flow system is shown generally in FIG. 1 where the brine is fed to the electrolyzer 1 through brine inlet 81*a* in the end unit 71, e.g., with a hydrostatic head. The brine then passes through conduit 83*a* in the "O" ring or gasket 61 to and through conduit 85*a* in the distributor 51 on the cathodic side 45 of cell 11, and thence to and through conduit 89*a* in the solid polymer unit 31 to anodic distributor 51 on the anodic side 35 of the solid polymer 31 of the electrolytic cell 11. At the distributor 51 there is a "T" opening and outlet with conduit 91*a* passing through the distributor 51 and outlet 87*a* delivering electrolyte to the anolyte chamber. The flow then continues, from conduit 91*a* in distributor 51 to conduit 93*a* in the next "O" ring or gasket through conduit 95*a* in the bipolar unit 21 and on to the next cell 13 where the fluid flow is substantially as described above. Brine is distributed by the packing 57 in the distributor 51 within the anolyte compartment 39. Distribution of the brine sweeps chlorine from the anodic surface 35 and anodic catalyst 37 to avoid chlorine stagnation.

The depleted brine is drawn through outlet 87*b* of the distributor 51 to return conduit 91*b* e.g. by partial vacuum or reduced pressure. The return is then through return conduit 89*b* in the solid polymer electrolyte unit 31, the conduit 85*b* in the cathodic distributor 51, conduit 83*b* in the "O" ring or gasket 61 to outlet 81*b* where the depleted brine is recovered from the electrolyzer 1.

While the brine feed has been shown with one inlet system and one outlet system, i.e. the recovery of depleted brine and chlorine through the same outlets, it is to be understood that depleted brine and chlorine may be separately recovered. It is also to be understood, that depending upon the internal pressure of the anolyte compartment 39 and the temperature of the anolyte liquor within the anolyte compartment, the chlorine may either be a liquid or a gas.

Water and oxidant enter the electrolyzer 1, through inlet 101*a* in the end unit 71. The water and oxidant then proceed through conduit 103*a* in the "O" ring or gasket 61 to conduit 105*a* and "T" in cathodic distributor 51 on the cathodic side 45 of cell 11. The "T" outlet includes conduit 105*a* and outlet 111*a*. Water and oxidant are delivered by outlet 111*a* in ring 53 of the distributor 51 to the catholyte resistant packing 55 within the catholyte chamber 45 of cell 11. The cell liquor, that is the aqueous alkali metal hydroxide, such as sodium hydroxide or potassium hydroxide, is recovered from the cathodic surface 41 of the solid polymer electrolyte permionic membrane 33 by the water carried into the cell 11. When oxidant is present, liquid is recovered through the outlet 111*b*. When there is no oxidant, gas and liquid may both be recovered through 111*b*, or, in an alternative exemplification, a separate gas recovery line, not shown, may be utilized.

While, the electrolyzer is shown with common feed for oxidant and water, and with common recovery for gas and liquid, there may be three conduits present, 111*a*, 111*b* and a third conduit, not shown, for water feed, oxidant feed, and liquid recovery. Alternatively, there may be three conduits 111*a*, 111*b* and a third conduit, not shown, for water feed, liquid recovery and gas recovery.

Returning to overall flows in the electrolyzer 1, conduit 105*a* continues to conduit 107*a* of the solid polymer electrolyte unit 31 to conduit 109*a* of the anodic distributor 51 which continues through to conduit 113*a* of the O ring or gasket 61 thence to conduit 115*a* of the bipolar unit 21, where the same path through individual cell 13 is followed as in cell 11. Similarly the network may be continued for further cells.

The recovery of product is shown as being from distributor 51 through outlet 111*b* to conduit 105*b* thence to conduit 103*b* in the O ring or gasket 61 to outlet 101*b* in the end wall 71.

While the flow is described as being to and through distributors 51, as described above, the flow could also be through other paths. For example, the inlet or outlet or both could be in the bipolar unit 21 which bipolar unit would carry porous film or outlet pipes from unit 21. Alternatively, the inlet or outlet or both could be part of the solid polymer electrolyte unit 31.

While the flow is described as being in parallel to each individual cell 11 and 13, it could be serial flow. Where serial flow of the brine is utilized, the T, outlet 87-conduit 91 can be an L rather than a T. In an exemplification where serial flow is utilized, there would be lower brine depletion in each cell, with partially depleted brine from one cell fed to the next cell for further partial depletion. Similarly, where there is serial flow of the catholyte liquor, the T, conduit 105-outlet 111 could be an L.

Where serial flow is utilized the flow could be concurrent with high sodium or high potassium ion concentration gradients across the solid polymer electrolyte 33 or countercurrent with lower sodium or potassium ion concentration gradients across the individual solid polymer electrolyte units 31.

The bipolar electrolyzer may be either horizontally or vertically arrayed, that is the bipolar electrolyzer 1 may have a solid polymer electrolyte units 31 with either a horizontal membrane 33 or a vertical membrane 33. Preferably the membrane 33 is horizontal with the anodic surface 35 on top of the permionic membrane 33 and the cathodic surface 41 on the bottom of the permionic membrane 33. A horizontal design offers various advantages. Under low pressure operation, chlorine bubbles flow up through the anolyte compartment 39. In the catholyte compartment 45, the horizontal configuration prevents the build up of concentrated alkali metal hydroxide on the bottom surface 41 of the permionic membrane 33, while allowing for the bottom surface 41 of the permionic membrane 33 to be wet with alkali metal hydroxide. Additionally, where oxidant is present, especially gaseous oxidant, the horizontal configuration allows the oxidant to be in contact with the cathodic surface 41 of the permionic membrane 33.

The solid polymer electrolyte 31 contains a permionic membrane 33. The permionic membrane 33 should be chemically resistant, cation selective, with anodic chlorine evolution catalyst 37 on the anodic surface 35 and cathodic, hydroxyl evolution catalyst 43 on the cathodic surface 41 thereof.

The flurocarbon resin permionic membrane 33 used in providing the solid polymer electrolyte 31 is characterized by the presence of cation selective ion exchange groups, the ion exchange capacity of the membrane, the concentration of ion exchange groups in the membrane on the basis of water absorbed in the membrane, and the glass transition temperature of the membrane material.

The flurocarbon resins herein contemplated have the moieties:

$$\left(CF_2-CXX'\right) \text{ and}$$

$$\left(CF_2-\underset{\underset{Y}{|}}{C}-X\right)$$

where X is —F, —Cl, —H, or $-CF_3$; X′ is —F, —Cl, —H, $-CF_3$ or $CF_3(CF_2)_m-$; m is an integer of 1 to 5; and Y is —A, —$\phi$—A, —P—A, or $-O-(CF_2)_n$ (P, Q, R)—A.

In the unit (P, Q, R), P is $-(CF_2)_a(CXX')_b(CF_2)_c$, Q is $(-CF_2-O-CXX')_d$, R is $(-CXX'-O-CF_2)_e$, and (P, Q, R) contains one or more of P, Q. R.

$\phi$ is the phenylene group; n is O or 1; a, b, c, d and e are integers from 0 to 6.

The typical groups of Y have the structure with the acid group, A, connected to a carbon atom which is connected to a fluorine atom. These include $\left(CF_2\right)_x A$, and side chains having either linkages such as: $-O\left(CF_2\right)_x A$, $$\left(O-CF_2-\underset{\underset{Z}{|}}{CF}\right)_y A,$$

$$\left(O-CF_2-\underset{\underset{Z}{|}}{CF}\right)_x \left(O-CF_2-CF_2\right)_y A, \text{ and}$$

$$-O-CF_2\left(CF_2-O-\underset{\underset{Z}{|}}{CF}\right)_x \left(CF_2\right)_y \left(CF_2-O-\underset{\underset{R}{|}}{CF}\right)_z A$$

where x, y, and z are respectively 1 to 10; Z and R are respectively —F or a $C_{1-10}$ perfluoroalkyl group, and A is the acid group as defined below.

In the case of copolymers having the olefinic and olefin-acid moieties above described, it is preferably to have 1 to 40 mole percent, and preferably especially 3 to 20 mole percent of the olefin-acid moiety units in order to produce a membrane having an ion-exchange capacity within the desired range.

A is an acid group chosen from the group consisting of $-SO_3H$
—COOH
$-PO_3H_2$, and
$-PO_2H_2$, or a group which may be converted to one of the aforesaid groups by hydrolysis or by neutralization.

In a particularly preferred exemplification of this invention, A may be either —COOH, or a functional group which can be converted to —COOH by hydrolysis or neutralization such as —CN, —COF, —COCl, $-COOR_1$, —COOM, $-CONR_2R_3$; $R_1$ is a $C_{1-10}$ alkyl group and $R_2$ and $R_3$ are either hydrogen or $C_1$ to $C_{10}$ alkyl groups, including perfluoroalkyl groups, or both. M is hydrogen or an alkali metal; when M is an alkali metal it is most preferably sodium or potassium.

In an alternative exemplification A may be either $-SO_3H$ or a functional group which can be converted to $-SO_3H$ by hydrolysis or neutralization, or formed from $-SO_3H$ such as $-SO_3M'$, $(SO_2-NH)$ M″, $-SO_2NH-R_1-NH_2$, or $-SO_2NR_4R_5NR_4R_6$; M′ is an alkali metal; M″ is H, $NH_4$ an alkali metal or an alkali earth metal; $R_4$ is H Na or K; $R_5$ is a $C_3$ to $C_6$ alkyl group, $(R_1)_2NR_6$, or $R_1NR_6(R_2)_zNR_6$; $R_6$ is H, Na, K or $-SO_2$; and $R_1$ is a $C_2$–$C_6$ alkyl group.

The membrane material herein contemplated has an ion exchange capacity from about 0.5 to about 2.0 milligram equivalents per gram of dry polymer, and preferably from about 0.9 to about 1.8 milligram equivalents per gram of dry polymer, and in a particularly preferred exemplification, from about 1.1 to about 1.7 milligram equivalents per gram of dry polymer. When the ion exchange capacity is less than about 0.5 milligram equivalents per gram of dry polymer the current efficiency is low at the high concentrations of alkaline metal hydroxide herein contemplated, while when the ion exchange capacity is greater than about 2.0 milligrams equivalents per gram of dry polymer, the current efficiency of the membrane is too low.

The content of ion exchange groups per gram of absorbed water is from about 8 milligram equivalents per gram of absorbed water to about 30 milligram equivalents per gram of absorbed water and preferably from about 10 milligram equivalents per gram of absorbed water to about 28 milligram equivalents per gram of absorbed water, and in a preferred exemplification from about 14 milligram equivalents per gram of absorbed water to about 26 milligram equivalents per gram of absorbed water. When the content of ion exchange groups per unit weight of absorbed water is less than about 8 milligram equivalents per gram or above about 30 milligram equivalents per gram the current efficiency is too low.

The glass transition temperature is preferably at least about 20° C. below the temperature of the electrolyte. When the electrolyte temperature is between about 95° C. and 110° C., the glass transition temperature of the fluorocarbon resin permionic membrane material is below about 90° C. and in a particularly preferred exemplification below about 70° C. However, the glass transition temperature should be above about −80° C. in order to provide satisfactory tensile strength of the membrane material. Preferably the glass transition temperature is from about −80° C. to about 70° C. and in a particularly preferred exemplification from about minus 80° C. to about 50° C.

When the glass transition temperature of the membrane is within about 20° C. of the electrolyte or higher than the temperature of the electrolyte the resistance of the membrane increases and the perm selectivity of the membrane decreases. By glass transition temperature is meant the temperature below which the polymer segments are not energetic enough to either move past one another or with respect to one another by segmental Brownian motion. That is, below the glass transition temperature, the only reversible response of the polymer to stresses is strain while above the glass transition temperature the response of the polymer to stress is segmental rearrangement to relieve the externally applied stress.

The fluorocarbon resin permionic membrane materials contemplated herein have a water permeability of less than about 100 millimeters per hour per square meter at 60° C. in four normal sodium chloride at a pH of 10 and preferably lower than 10 milliliters per hour per square meter at 60° C. in four normal sodium chloride of the pH of 10. Water permiabilities higher than about 100 milliliters per hour per square meter, measured as described above, may result in an impure alkali metal hydroxide product.

The electrical resistance of the dry membrane should be from about 0.5 to about 10 ohms per square centimeter and preferably from about 0.5 to about 7 ohms per square centimeter.

Preferably the fluorinated-resin permionic membrane has a molecular weight, i.e., a degree of polymerization, sufficient to give a volumetric flow rate of about 100 cubic millimeters per second at a temperature of from about 150° to about 300° C.

The thickness of the permionic membrane 33 should be such as to provide a membrane 33 that is strong enough to withstand pressure transients and manufacturing processes, e.g., the adhesion of the catalyst particles but thin enough to avoid high electrical resistivity. Preferably the membrane is from 10 to 1000 microns thick and in a preferred exemplification from about 50 to about 200 microns thick. Additionally, internal reinforcement, or increased thickness, or crosslinking may be utilized, or even lamination may be utilized whereby to provide a strong membrane.

In an alternative exemplification, the permionic membrane includes means for carrying anolyte liquor into the interior of the permionic membrane. This serves to prevent crystallization of alkali metal chloride salts within the permionic membrane 33. The means for accomplishing this include wicking means, for example, extending up to or beyond the anodic catalyst 37. According to a further exemplification, the means for carrying anolyte liquor into the interior of the permionic membrane may include hydrophilic or wettable fibers extending up to or beyond the anode catalyst 37 or even microtubes extending up to or beyond the anode catalyst 37.

The means for carrying the anolyte liquor into the interior of the permionic membrane, as described above, draw water or anolyte liquor into the membrane beyond the water of hydration associated with the electrolytically carried alkali metal ions. This is to prevent the crystallization of alkali metal chloride such as sodium chloride or potassium chloride in the membrane.

In a preferred exemplification of the method and structure of this invention, the electrocatalysts 37 and 43 and the membrane 33 are one unit. While this may be provided by having the electrocatalysts 37 and 43 on the distributor packing 55 and 57, with the distributor 55 and 57 maintained in a compressive relationship with the membrane 33, it is preferred to provide a film of the electrocatalyst 37 and 43 on the permionic membrane 33. The film is generally from about 10 microns to about 200 microns thick, preferably from about 25 to about 175 microns thick, and ideally from about 50 to about 150 microns thick.

The electrocatalyst-permionic membrane unit 31 should have dimensional stability, resistance to chemical and thermal degradation, electrocatalytic activity, and preferably the catalyst particles should be finely divided and porous with at least about 10 square meters of surface area per gram of catalyst particle.

Adherence of the catalyst, 37 and 43, to the permionic membrane 33 may be provided by pressing the particles 37, 43 into a molten, semi-molten, fluid, plastic, or thermoplastic permionic membrane 33 at elevated temperatures. That is, the membrane is heated above its glass transition temperature, and preferably above the temperature at which the membrane 33 may be deformed by pressure alone. According to a still further exemplification, the particles 37 and 43 may be pressed into a partially polymerized permionic membrane 33 or pressed into a partially cross-linked permionic membrane 33 and the polymerization or crosslinking carried forward, for example, by raising or lowering the temperature, adding initiator, adding additional monomer, or the use of ionizing radiation, or the like.

According to a further exemplification of the method of this invention, where further polymerization is carried out, the particles 37,43 may be embedded in the partially polymerized permionic membrane 33. Thereafter, a monomer of a hydrophobic polymer can be applied to the surface, with, for example, an initiator, and copolymerized, in situ, with the partially polymerized permionic membrane 33, whereby to provide a hydrophobic surface having exposed particles 37,43. In this way the catalyst particles 37,43 may be present in a hydrophobic surface, e.g., to protect the anodic surface 35 from chlorine, or to protect the cathodic surface 41 from the crystallization or solidification of alkali metal hydroxide, or to enhance depolarization as when an $HO_2^-$ disproportionation catalyst is present on the cathodic surface 41 of the permionic membrane.

According to a still further exemplification of the method of this invention, the catalysts 37,43 may be electrodeposited on the permionic membrane 33. Additionally, there may be subsequent activation of the electrodeposited catalyst, for example, by codeposition of a leachable material with a less leachable material and subsequent activation by leaching out the more leachable material.

According to a still further exemplification of the method of this invention, the electrode materials 37,43 may be chemically deposited on the permionic membrane, for example, by hypophosphite or borohydrite chemical deposition. Any metal amenable to chemical deposition may be used, especially transition metals of Group VIII, such as ion, cobalt, nickel, ruthenium, rhodium, palladium, osmium, iridium, and platinum. Additionally, the method may be used with metals of Group IVb, such as titanium, zirconium and hafnium, the metals of Group Vb, such as vanadium, columbium, and tantalum, the metals of Group VI B, such as chromium, molybdenum, and tungsten, and the metals of Group VII B, such as manganese, technetium, and rhenium. According to a further exemplification of the method of this invention where chemical deposition is used, two or more metals may be codeposited and one or more of them may be removed, by utilizing an activating agent such as a strong acid or strong base. For example, nickel, iron and molybdenum may be codeposited, and the nickel and molybdenum left on the surface as the iron is removed. Alternatively, nickel, molybdenum and chromium may be codeposited and the chromium removed to leave nickel and molybdenum behind. According to a still further exemplification, nickel, iron and either tantalum, tungsten, molybdenum, technetium, or rhenium may be deposited and the iron removed whereby to leave a surface containing nickel, with either titanium, zirconium, hafnium, vanadium, columbium, tantalum, molybdenum, tungsten, manganese, technetium, or rhenium. In this way, a particularly desirable catalytic surface, especially a cathodic surface 43, may be readily provided.

According to a still further exemplification, a surface of catalyst 37,43 may be applied to the permionic membrane by electrophoretic deposition, by sputtering, by laser deposition, or by photodeposition.

According to a still further exemplification of the method of this invention, a catalytic coating 37,43 may be applied to the permionic membrane 33 utilizing a chelate of a metal which reacts with the acid groups of the permionic membrane 33.

In a particularly preferred exemplification the catalyst 37, 43 is deposited as a highly irregular surface characterized by microscopic needles, ridges, peaks and valleys, with many planes substantially perpendicular to the plane of the permionic membrane 33. In this way, even after erosion there is still a high ratio of surface area to mass of catalyst.

Typically, the anodic catalyst 37 on the anodic surface 35 of the permionic membrane 33 is a precious metal-containing catalyst, such as a platinum group metal or alloy of a platinum group metal or an intermetallic compound of a platinum group metal, or an oxide, carbide, nitride, boride, silicide, or sulphide of a platinum group metal. Such precious metal-containing catalysts are characterized by a high surface area and the capability of either being bonded to a hydrophobic particle or being embedded in the hydrophobic film. Additionally, the precious metal-containing catalyst may be a partially reduced oxide, or a black, such as platinum black or palladium black, or an electrodeposit or chemical deposit.

The anodic catalysts 37 may also be an intermetallic compound of other metals, including precious metals or non-precious metals. Such intermetallic compounds include pyrochlores, delafossites, spinels, perovskites, bronzes, tungsten bronzes, silicides, nitrides, carbides and borides.

Especially desirable cathodic catalysts which may be present on the solid polymer electrolyte permionic membrane 33 include steel, stainless steel, cobalt, nickel, alloys of nickel or iron, compositions of nickel, especially porous nickel with molybdenum, tantalum, tungsten, titanium, columbium or the like, and electrically conductive, electrically active borides, nitrides, silicides and carbides, such as, the platinum group metal silicides, nitrides, carbides and borides and titanium diboride.

Other cathodic catalysts 43 that may be present on the cathodic surface 41 of the permionic membrane include the platinum group metals, e.g., platinum, palladium, ruthenium, osmium, iridium, and rhodium, both as smooth deposits for as high surface area deposits, e.g., "blacks" having a surface area in excess of 10 square meters per gram.

In preparing the solid polymer electrolyte unit 31 herein contemplated with a permionic membrane 33 having an anodic catalyst 37 and a cathodic catalyst 43, one particularly desirable method is electroless deposition, that is, chemical deposition.

As herein contemplated the permionic membrane 33, or one surface thereof, e.g., the anodic surface 35 or cathodic surface 41, is contacted with a reducing agent, a complexing agent, a buffer, and a compound of the metal, or compounds of the metals to be deposited. The reducing agent may be a borohydride reducing agent or a hypophosphite reducing agent. The borohydride solution should contain 1 to 5 grams per liter of borohydride, e.g., sodium or potassium borohydride, and preferably 1.5 to 2.5 grams per liter of borohydride.

Where the deposition is on a synthetic permionic membrane, 33, rather than a metal substrate, sequential contact is particularly desirable. In sequential contact the membrane 33, is first contacted with the reducing agent, and thereafter with the compounds of the metals to be deposited.

This may be carried out by preparing a first solution of reducing agent and a second solution of the compounds of the metal or metals to be deposited, including the complexing agents and buffers and contacting the permionic membrane 33 first with the reducing agent, then with the aqueous solution of the metal compounds, washing off excess reactants, and sequentially contacting the permionic membrane 33 with reducing agent solution and second solution whereby to provide a porous, high surface area coating.

The method of this invention is advantageous with transition metals, and is particularly advantageous with group VIII transition metals. It is especially useful for the codeposition of two Group VIII metals of dissimilar resistance to chemical leachants, and the subsequent leaching of the less resistant metal.

The borohydride is preferably an alkali metal borohydride, as sodium or potassium borohydride. The transition metal is present in the second solution as a soluble salt, e.g., a citrate, oxalate, glycolate, sulfate, or chloride. The buffer and the complexing agent may be the acid and the alkali metal salt of the same organic union, e.g., sodium citrate and citric acid, sodium oxalate and oxalic acid, and the like. Alternatively, an inorganic acid, e.g., phosphoric acid and sodium phosphite may be used.

The complexing agent and buffer serve to maintain the Group VIII metal ions in solution, e.g., at a pH of 6 to 8.

There is then prepared a second solution of compound of a platinum group metal which solution also contains a complexing agent and a buffer. The permionic membrane 33 is contacted first with the borohydride solution, the excess solution being wiped off. Thereafter, the permionic membrane 33 is contacted with the second solution whereby to provide a thin layer or film of a platinum group metal on the permionic membrane. This is continued sequentially, until a surface layer is built up to a thickness of about 50 to about 500 Angstrom.

According to an alternative exemplification of this invention, there is provided a porous nickel coating by first chemically depositing a thin layer, for example, about 5 to about 25 Angstrom of nickel onto the permionic membrane 33 and thereafter codepositing, for example, by hypophosphite reduction, nickel and iron onto the previously applied nickel coating of the permionic membrane 33. A nickel-iron codeposit coating approximately 50 to 500 Angstrom is deposited atop the nickel coating by sequential application of hypophosite and iron and nickel compounds. Thereafter, the iron is leached out, for example, by contact with a strong acid or strong alkali. Typical strong acids include acetic acid, various haloacetic acids, hydrochloric acid, hydrofluoric acid, nitric acid, sulfuric acid, sulfurous acid, and aqua regia. Preferably, the acid is a mineral acid, as described above, and preferably one normal hydrochloric acid. Alternatively, strong alkalis such as aqueous sodium hydroxide or potassium hydroxide may be used.

According to an alternative exemplification of the method of this invention, iron and nickel may be codeposited by borohydride reduction rather than hydophosite reduction and the iron removed as described hereinabove.

According to a still further exemplification of this invention, there may be provided a porous nickel coating admixed with a material such as molybdenum, tantalum, tungsten, hafnium, zirconium or the like as utilizing the method described above.

In the electrolysis of alkali metal chloride brines, such as potassium chloride and sodium chloride brines in solid polymer electrolytic cell, especially one having carboxylic acid-type permionic membrane, 33, the content of transition metals in the brine should be less than 40 parts per million, and preferably less than 20 parts per million, whereby to avoid fouling the permionic membrane 33. The pH of the brine should be low enough to avoid precipitation of magnesium ions. The calcium content should be less than 50 parts per billion, and preferably less than 20 parts per billion. The brine should be substantially free of organic carbon compounds, especially, where the chlorine is to be recovered directly from the cell as a liquid and utilized in a further process, for example, an organic synthesis process such as vinyl chloride manufacturing process, without further treatment.

In the operation of the cell, short residence time in the anolyte compartment 39 for the brine depletion of about 10 to about 15 percent allows the utilization of brine as a coolant and avoids concentration polarization. However, higher brine depletions, for example, 30, 40, even 50, 60 or 70 percent, may be utilized.

The temperature of the cell should be above 9 degrees C., especially when the brine is low in pH whereby to further reduce chlorine hydrate formation. Alternatively, the temperature of the cell may be maintained below 9° C., whereby to enhance chlorine hydrate formation and allow the recovery of a slurry of brine and chlorine hydrate.

The cell temperature should be low enough so that when liquid chlorine is recovered from a pressurized cell the pressure necessary to maintain the chlorine liquid is low enough to permit conventional construction techniques rather than high pressure techniques to be utilized. The pressure-temperature data of liquid chlorine is reproduced in Table I.

TABLE I

VAPOR PRESSURE OF LIQUID CHLORINE

| Temperature °C. | Temperature °F. | Gage Pressure, Pounds per Square Inch |
|---|---|---|
| −30 | −22 | 3.1 |
| −25 | −13 | 7.2 |
| −20 | −4 | 13.4 |
| −15 | +5 | 17.2 |
| −10 | 14 | 23.5 |
| −5 | 23 | 30.6 |
| 0 | 32 | 38.8 |
| +5 | 41 | 47.8 |
| 10 | 50 | 58.2 |
| 15 | 59 | 68.9 |
| 20 | 68 | 81.9 |
| 25 | 77 | 95.4 |
| 30 | 86 | 111.7 |
| 35 | 95 | 129.9 |
| 40 | 104 | 149.0 |
| 45 | 113 | 170.8 |
| 50 | 122 | 193.1 |
| 55 | 131 | 218.1 |
| 60 | 140 | 243.8 |
| 65 | 149 | 271.0 |
| 70 | 158 | 302.4 |
| 75 | 167 | 335.7 |
| 80 | 176 | 370.9 |
| 85 | 185 | 409.1 |
| 90 | 194 | 448.8 |
| 95 | 203 | 492.2 |
| 100 | 212 | 536 |
| 105 | 221 | 586 |

TABLE I-continued

| VAPOR PRESSURE OF LIQUID CHLORINE | | |
|---|---|---|
| Temperature °C. | °F. | Gage Pressure, Pounds per Square Inch |
| 110 | 230 | 638 |
| 115 | 239 | 694 |
| 120 | 248 | 756 |
| 125 | 257 | 822 |
| 130 | 266 | 888 |
| 135 | 275 | 960 |
| 140 | 284 | 1035 |
| — | — | — |

When the electrolyzer is operated to recover liquid chlorine, the pressure should be high enough to maintain the chlorine liquid. In this way, liquid chlorine and depleted brine may be recovered together, the liquid chlorine separated from the brine, the brine then cooled to convert any chlorine therein to chlorine hydrate, which is further separated from the brine, and the brine refortified in salt, repurified and returned to the cell while the chlorine hydrate separated therefrom is heated to form chlorine.

The pressure in the electrolyzer should be high enough to allow gaseous nitrogen and oxygen to be vented from the cell or cell auxiliaries, without evaporating significant amounts of liquid chlorine. When operating to produce liquid chlorine taining the chlorine liquid the temperature of the cell should be below about 100° C., whereby to maintain the design pressure on the electrolyzer below about 600 pounds per square inch gage. Preferably, the temperature of the cell should be below about 50° C. whereby to allow design pressure of the cell to be below about 200 pounds per square inch. However, the desired temperature and pressure of the cell may depend upon the end use of the liquid chlorine and the required vapor pressure and temperature of the liquid chlorine. As a practical matter, the pressure within the cell is dependent more upon the pressure of the auxiliaries and end use of the chlorine rather than the structural components of the cell.

High pressure is particularly advantageous, on the catholyte side 45 of the individual electrolytic cell 11, where the cathodic reaction is depolarized, as the high pressure serves to force the depolarizer into the catalyst 43 and disproportionate the $HO_2^-$.

In the operation of the cell, the removal of stagnate chlorine pockets from the anodic surface and the removal of solid, crystallized, or highly concentrated liquid alkali metal hydroxides from the cathodic surface 41 of the permionic membrane 33 may be carried out utilizing either pulsed electrical current or ultrasonic vibration of the permionic membrane 33. Preferably pulsed electrical current is used. Where a pulsed current is utilized it may be pulsed direct current, rectified alternating current, or rectified half-wave alternating current. Particularly preferred is pulsed direct current having a frequency of from about 100 to about 400 cycles per second, and preferably about 200 to about 400 cycles per second.

The catholyte liquor recovered from the cell typically will contain in excess of 20 weight percent alkali metal hydroxide. Where, as in a preferred exemplification, the permionic membrane 33 is a carboxylic acid membrane, as described hereinabove, the catholyte liquor may contain in excess of 30 to 35 percent, for example 40 or even 45 or more weight percent alkali metal hydroxide.

The current density of the solid polymer electrolyte electrolytic cell 11 may be higher than that in a conventional permionic membrane or diaphragm cell, for example, in excess of 200 amperes per square foot, and preferably in excess of 400 amperes per square foot. According to one preferred exemplification of this invention, electrolysis may be carried out at a current density of 800 or even 1,200 amperes per square foot, where the current density is defined as total current passing through the cell divided by the surface area of one side of the permionic membrane 33.

According to a particularly preferred exemplification of the method of this invention, the cathode may be depolarized whereby to eliminate the formation of gaseous cathodic products. In operation with the depolarized cathode, oxidant is fed to the cathodic surface 41 of the solid polymer electrolyte 31 while providing a suitable catalyst 43 in contact with the cathodic surface 41 of the solid polymer electrolyte 31 whereby to avoid evolution of gaseous hydrogen. In this way, when the electrolyzer, 1, and electrolytic cell, 11, is maintained at an elevated pressure, as described hereinabove, the evolution of gaseous products can be largely avoided, as can the problems associated therewith.

In the process of producting alkali metal hydroxide and chlorine by electrolyzing an alkali metal chloride brine, such as an aqueous solution of sodium chloride or potassium chloride, the alkali metal chloride solution is fed into the cell, a voltage is imposed across the cell, chlorine is evolved at the anode, alkali metal hydroxide is produced in the electrolyte in contact with the cathode, and hydrogen may be evolved at the cathode. The overall anode reaction is:

$$2Cl^- \rightarrow Cl_2 + 2e^- \quad (1)$$

while the overall cathode reaction is:

$$2H_2O + 2e^- \rightarrow H_2 + 2OH^- \quad (2)$$

More precisely, the cathode reaction is reported to be:

$$H_2O + e^- \rightarrow H_{ads} + OH^- \quad (3)$$

by which the monatomic hydrogen is absorbed onto the surface of the cathode. In basic media, the adsorbed hydrogen is reported to be desorbed according to one of two alternative processes:

$$2H_{ads} \rightarrow H_2 \quad (4)$$

or $$H_{ads} + H_2O + e^- \rightarrow H_2 + OH \quad (5)$$

The hydrogen desorption step, i.e., reaction (4) or reaction (5), is reported to be the hydrogen overvoltage determining step. That is, it is the rate controlling step and its activation energy corresponds to the cathodic hydrogen overvoltage. The cathode voltage for the hydrogen evolution reaction (2) is on the order of about 1.5 to 1.6 volts versus a saturated calomel electrode (SCE) on iron in basic media of which the hydrogen overvoltage component is about 0.4 to 0.5 volt.

One method of reducing the cathode voltage is to provide a substitute reaction for the evolution of gaseous hydrogen, that is, to provide a reaction where a liquid product is formed rather than gaseous hydrogen.

Thus, water may be formed where an oxidant is fed to the cathode. The oxidant may be a gaseous oxidant such as oxygen, air, or the like. Alternatively, the oxidant may be a liquid oxidant such as hydrogen peroxide, a hydroperoxide, hydrogen peroxide or a peroxy acid or the like.

When the oxidant is oxygen, e.g., as air or as gaseous oxygen, the following reaction is believed to take place at the cathode:

$$O_2+2H_2O+4e^-\rightarrow 4OH \quad (6)$$

This reaction is postulated to be an electron transfer reaction:

$$O_2+H_2O+2e^-\rightarrow HO_2^-+OH^- \quad (7)$$

followed by a surface reaction:

$$2HO_2^-\rightarrow O_2+2OH^- \quad (8)$$

It is believed that the prodominant reaction on the hydrophobic surface is reaction (7), with reaction (8) occurring on the surfaces of the catalyst particles 43 dispersed in and through the cathode surface 41 of the solid polymer electrolyte 33. Such catalyst particles include particles of electrocatalysts as described hereinbelow. In this way, the high overvoltage hydrogen desorption step is eliminated.

Where the oxidant is a peroxy compound, the following reaction is believed to take place at the cathode:

$$RCOO^-+2H_2O+2e^-\rightarrow RCOH+3OH^- \quad (9)$$

This reaction is postulated to be an electron transfer reaction followed by a surface reaction.

According to a still further exemplification the oxidant may be a redox couple, i.e., a reduction-oxidation couple, where the oxidant is reduced inside the cell and thereafter oxidized outside the cell, as for return to the cell. One suitable redox couple is a copper compound which can be fed to the cell 11 as a cupric compound, reduced to a cuprous compound at the cathode 43, and recovered from the catholyte compartment 45 as a cuprous compound. Thereafter, the cuprous compound may be oxidized to a cupric compound outside of the electrolyzer 1, and returned to the electrolyzer. Suitable copper couples include chelated copper couples such as phthalocyanines.

According to a further exemplification of the method of this invention, where a redox couple is utilized, the redox couple may be a quinone-hydroquinone redox couple. In this case the quinone is electrolytically reduced to hydroquinone at the cathode 43, hydroquinone is recovered from the catholyte liquor 45, and oxidized to quinone externally of the cell.

The cathode catalysts useful in carrying out the method of this invention are those having properties as $HO_2^-$ disproportionation catalysts, i.e., catalysts that are capable of catalyzing the surface reaction $$2HO_2^-\rightarrow O_2+2OH^- \quad (10).$$

Additionally, the catalyst should either be capable of catalyzing the electron transfer reaction $$O_2+H_2O+2e^-\rightarrow HO_2^-+OH^- \quad (11),$$

or of being used in conjunction with such a catalyst. The catalysts herein contemplated should also be chemically resistant to the catholyte liquor.

Satisfactory $HO_2^-$ disproportionation catalysts which may be utilized in combination with the catalysts described abkove include carbon, the transition metals of Group VIII, being iron, cobalt, nickel, palladium, ruthenium, rhodium, platinum, osmium, iridium, and compounds thereof. Additionally, other catalysts such as copper, lead and oxides of lead may be used. The transition metals may be present as the metals, as alloys, and as intermetallic compounds. For example, when nickel is used, it may be admixed with Mo, Ta, or Ti. These admixtures serve to maintain a low cathodic voltage over extended periods of electrolysis.

Any metal of Group III B, IV B, V B, VI B, VII B, I B, II B, or III A, including alloys and mixtures thereof, which metal or alloy is resistant to the catholyte can be used as the cathode coating 43 or catalyst on the surface of the membrane 33.

Additionally, solid metalloids, such as phthalocyanines of the Group VIII metals, perovskites, tungsten bronzes, spinels, delafossites, and pyrochlores, among others, may be used as a catalytic surface 43 of the membrane 33.

Particularly preferred catalysts are the platinum group metals, compounds of platinum group metals, e.g., oxides, carbides, silicides, phosphides, and nitrides thereof, and intermetallic compounds and oxides thereof, such as rutile form $RuO_2$—$TiO_2$ having semiconducting properties, Where a gaseous oxidant, as air or oxygen is utilized, the portion of the catalyst intended for electron transfer is hydrophilic while the portion intended for the surface reaction may be hydrophilic or hydrophobic and preferably hydrophobic. The surface reaction catalyst is hydrophobic or is embedded in or carried by a hydrophobic film. The hydrophobic film may be a porous hydrophobic material such as graphite or a film of a fluorocarbon polymer on the catalyst. The surface reaction catalyst, as described above, and the electron transfer catalyst should be in close proximity. They may be admixed, or they may be different surfaces of the same particle. For example, a particularly desirable catalyst may be provided by a microporous film on the permionic membrane surface 41 with catalyst 43 carried by a hydrophobic microporous film, or by the catalysts, described above, carried on a hydrophobic carrier.

According to a further exemplification of this invention utilizing a depolarized cathode, the electrodes can be weeping electrodes i.e. electrodes that weep oxidant. In the utilization of weeping electrodes, the oxidant is distributed through the distributor 51 to the catalytic particles 43 thereby avoiding contact with catholyte liquor in the catholyte compartment 45. Alternatively, the oxidant may be provided by a second distributor means, bearing upon the cathodic surface 41 of the permionic membrane 33 or upon the catalytic particles 43.

The feed of oxidant may be gaseous, including excess air or oxygen. Where excess air or oxygen is utilized, the excess air or oxygen serves as a heat exchange medium to maintain the temperature low enough to keep the liquid chlorine vapor pressure low. Alternatively, the use of multiple oxidants, such as air and oxygen, or air and a peroxy compound, or oxygen and a peroxy compound, or air or oxygen and a redox couple, may be utilized. When air or oxygen is used as the oxidant, it should be substantially free of carbon dioxide whereby to avoid carbonate formation on the cathode.

Utilization of a horizontal cell is particularly advantageous where cathode depolarization is utilized. Especially satisfactory is the arrangement where the anodic surface 35 of the permionic membrane 33 and the anodic catalyst 37 are on top of the permionic membrane 31 and the cathodic surface 41 and cathodic catalyst 43 are on the bottom of the permionic membrane 33. This avoids flooding the oxidation catalyst, that is, the $HO_2^-$ disproportionation catalyst, with alkali metal hydroxide, while providing a thin film of alkali metal hydroxide at the membrane surface 41 adjacent to the cathode surface and enhances the contact of the catalyst 43 and the oxidant.

While the method of this invention has been described with reference to specific exemplifications, embodiments, and examples, the scope is not to be limited except as limited by the claims appended hereto.

I claim:

1. A method of depositing a catalyst to form a solid polymer electrolyte comprising contacting a permionic membrane with a first solution comprising a reducing agent chosen from the group consisting of hypophosphites and borohydrides, and thereafter contacting the permionic membrane with a second solution comprising salts of metals more and less leachable to be deposited on the permionic membrane, a complexing agent, and a buffer; codepositing a more leachable and a less leachable transition metal on the permionic membrane and leaching out the more leachable transition metal.

2. The method of claim 4 wherein the transition metals are Group VIII transition metals.

3. The method of claim 2 wherein the transition metals are chosen from the group consisting of nickel and the platinum group metals.

4. The method of claim 2 wherein the transition metals comprise iron and a second Group VIII transition metal and leaching out the iron.

* * * * *

UNITED STATES PATENT AND TRADEMARK OFFICE

CERTIFICATE OF CORRECTION

PATENT NO. : 4,250,013

DATED : February 10, 1981

INVENTOR(S) : William W. Carlin

It is certified that error appears in the above-identified patent and that said Letters Patent are hereby corrected as shown below:

Claim 2, line 1, "Claim 4" should be --Claim 1--.

Signed and Sealed this

*Eighth* Day of *September 1981*

[SEAL]

*Attest:*

GERALD J. MOSSINGHOFF

*Attesting Officer*

*Commissioner of Patents and Trademarks*